United States Patent [19]

Kurimsky

[11] 4,003,497

[45] Jan. 18, 1977

[54] DELIVERY SYSTEM FOR FIFO MERCHANDISING MACHINE

[75] Inventor: Albert Kurimsky, Dover, N.J.

[73] Assignee: Rowe International Inc., Whippany, N.J.

[22] Filed: Aug. 10, 1973

[21] Appl. No.: 387,327

Related U.S. Application Data

[63] Continuation of Ser. No. 210,380, Dec. 21, 1971, abandoned.

[52] U.S. Cl. ..... 221/84

[51] Int. Cl.² ..... G07F 11/82

[58] Field of Search ..... 221/81–86, 221/155, 90

[56] References Cited

UNITED STATES PATENTS

| | | | |
|---|---|---|---|
| 1,691,998 | 11/1928 | Smith | 221/83 |
| 1,926,662 | 9/1933 | Antoine | 221/84 |
| 3,194,432 | 7/1965 | Breitenstein | 221/82 |
| 3,227,307 | 1/1966 | Auerbach | 221/84 |
| 3,286,880 | 11/1966 | Gross | 221/82 |

*Primary Examiner*—Stanley H. Tollberg
*Attorney, Agent, or Firm*—Shenier & O'Connor

[57] ABSTRACT

An improved delivery system for a merchandising machine of the first-in first-out type in which each section comprises a spring clutch adapted to be actuated to couple a gear train to a common drive shaft to rotate an escrow member and to step a chain of merchandise-carrying paddles to cause a surface of the escrow member and one of the paddles, which together support the article next to be dispensed in a viewing position, to open in the manner of a trap door to deliver that article to a tray which is accessible to the customer.

15 Claims, 7 Drawing Figures

INVENTOR.
Albert Kurimsky
BY
Shenier & O'Connor
ATTORNEYS

INVENTOR.
Albert Kurimsky
BY
Shenier & O'Connor
ATTORNEYS

INVENTOR.
Albert Kurimsky
BY
Shenier & O'Connor
ATTORNEYS

INVENTOR.
Albert Kurimsky
BY
Shenier & O'Connor
ATTORNEYS

INVENTOR.
Albert Kurimsky
BY
Shenier & O'Connor
ATTORNEYS

DELIVERY SYSTEM FOR FIFO MERCHANDISING MACHINE

This is a continuation of application Ser. No. 210,380 filed Dec. 21, 1971, now abandoned.

BACKGROUND OF THE INVENTION

There are known in the prior art merchandising machines which are adapted selectively to deliver articles of merchandise such as candy, articles of pastry, bags of potato chips and the like to a customer. Respective sections of such machines are adapted to deliver articles of different size. For example, one section may be adapted to dispense bags of potato chips or the like and another section to dispense candy bars. Such machines generally are of the first-in first-out or FIFO type so that articles first loaded in the machine are first dispensed.

Auerbach et al U.S. Pat. No. 3,227,307 discloses a machine of the type described above. In the machine shown in the Auerbach et al patent, each section comprises a continuous chain of merchandise-supporting paddles or shelves, as well as an escrow member of triangular configuration located below and in front of the belt. One surface of the escrow member normally supports the article next to be dispensed behind a window through which it can be viewed by the customer. In operation of the machine, when a sum aggregating the purchase price of an article has been deposited in the machine and when a button corresponding to the section containing the desired article has been actuated, complicated linkages operate so as first to rotate the escrow member to a position at which the article supported thereon is delivered by gravity and then to step the chain to slide the next article from a shelf to the succeeding or following surface of the escrow member. While this machine operates in a generally satisfactory manner, it incorporates a number of defects.

Owing to the fact that the escrow member is first moved to deliver an article before the chain is stepped to replace the article on the escrow member, the vending cycle is somewhat longer than is desirable. Owing to the fact that the escrow member rotates to deliver its article before the chain is stepped, some clearance must be provided between the ends of the escrow member surfaces and the tips of the shelves. The machine is not as compact as is desirable. Since the machine relies on gravity entirely to deliver an article, a stuck package of chips or the like will not be dispensed. Further, as is pointed out hereinabove, respective sections of the machine may have to dispense articles of different size. In order to achieve this result, belts with different inter-shelf or inter-paddle facings must be provided for the different sections.

I have invented an improved delivery mechanism for a FIFO merchandising machine which overcomes the defects of machines of the prior art pointed out hereinabove. The operating mechanism of my system is appreciably simpler than are mechanisms of the prior art. My system is more compact than are delivery systems of the prior art. My machine makes provision for positively delivering a stuck package. The respective sections of my machine may readily be made to deliver articles of different size without extensive modification of the machine.

SUMMARY OF THE INVENTION

One object of my invention is to provide an improved delivery mechanism for FIFO merchandising machines which is more compact than are mechanisms of the prior art.

Another object of my invention is to provide an improved delivery mechanism for FIFO merchandising machines which is simpler than are mechanisms of the prior art.

Another object of my invention is to provide an improved delivery mechanism for a FIFO merchandising machine which minimizes the problems resulting from stuck articles.

Still another object of my invention is to provide an improved delivery mechanism for FIFO merchandising machines which permits adjacent sections of the machine to deliver articles of different size without extensive modification of the machine.

Other and further objects of my invention will appear from the following description.

In general my invention contemplates the provision of an improved delivery mechanism for a FIFO merchandising machine in which each section of the machine comprises a spring clutch adapted to be actuated to couple a gear train to a common drive shaft to rotate an escrow member and to step a delivery paddle belt to cause a paddle on the belt and a surface on the escrow member to open in the manner of a trap door to deliver an article which theretofore had been supported by the escrow member surface and by the paddle in a position to be viewed.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
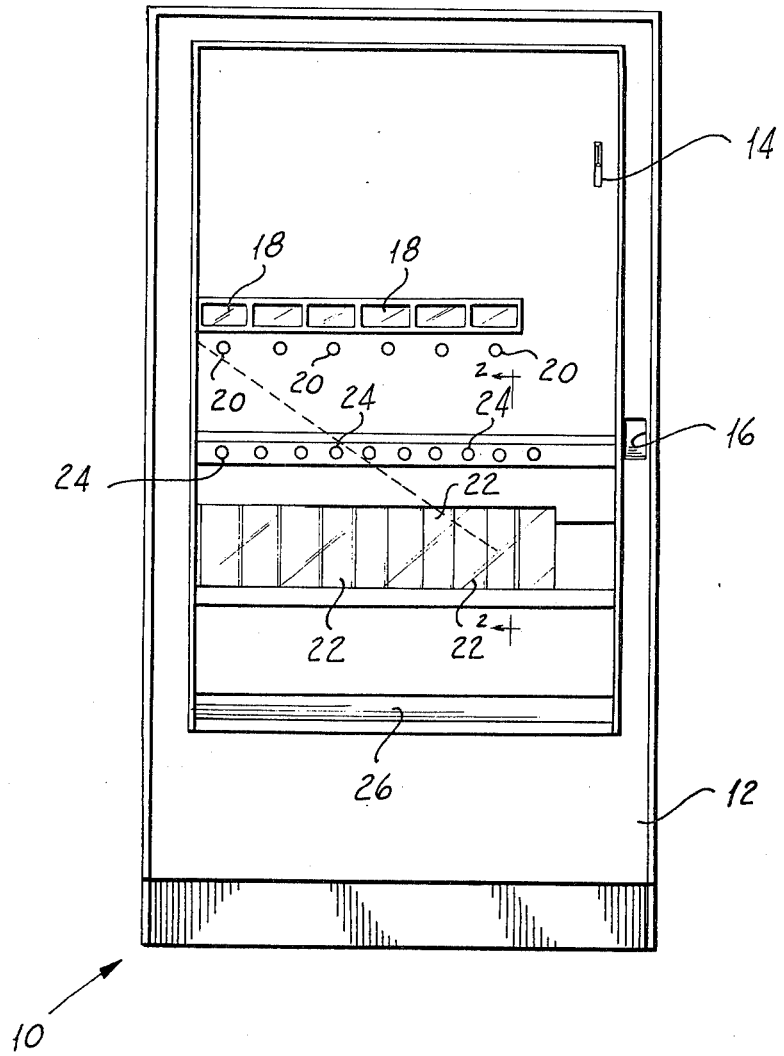
FIG. 1 is a front elevation of a merchandising machine including my improved delivery mechanism.

Referring now to the drawings, a FIFO merchandising machine, indicated generally by the reference character 10, with which my delivery system can be used, includes a cabinet door 12 having a coin slot 14 and a coin return opening 16. The door is provided with a plurality of windows 18 through which selections of gum and mint can be viewed. The gum and mint delivery apparatus which, per se, forms no part of my invention, is shown and described in the copending application of Joseph P. Allocco, Ser. No. 40,262, filed May 25, 1970, now abandoned. That mechanism is actuated in response to the operation of push buttons 20. Located in the cabinet door 12 below the buttons 20 are a plurality of windows 22 through which selections of candy bars, pastry, potato chips and the like can be viewed. My dispensing mechanism, to be described hereinafter, is actuated in response to operation of a push button 24 above the window 22 through which the selected article can be viewed. In response to operation of either a push button 20 or a push button 24 the selected article is delivered to the customer at a tray 26.

The machine 10 includes a plurality of pairs of storage units indicated generally by the reference characters 28 and 30 arranged across the front of the machine. Each unit 30 includes an upper idler sprocket wheel 32 carried by a shaft 34 rotatably supported in left-hand and right-hand panels 36 and 38 secured to the back panel 40 of the supply and delivery unit. The entire supply and delivery unit may be mounted on a hinge to permit it to be swung outwardly to a location at which the shelves to be described can be loaded from the back of the unit. Such a construction is more fully shown and described in the Auerbach et al patent referred to hereinabove.

Each unit 28 and 30 further includes a lower drive sprocket wheel 42 carried by a shaft 44 which also is rotatably supported in the panels 36 and 38. Respective inner and outer guide tracks 46 and 48 on each of the panels 36 and 38 extend from adjacent the top of the section downwardly and around the lower drive sprocket wheel 42.

The sprocket wheels 32 and 42 support a chain of merchandise-holding paddles or shelves 50. Each of these paddles is formed with a base 52 having upper teeth 54 and lower teeth 56. Sockets 58 formed on one of two adjacent shelves are adapted to receive pivots 60 on the adjacent shelf to form a chain of shelves. When two adjacent shelves are assembled in this manner, the teeth 54 mesh with the teeth 56. Moreover, the sockets 58 are located in the space between the inner and outer guides 46 and 48 on the panels 36 and 38. The rear of each base 52 is formed with a lug 62 adapted to be engaged by the teeth of wheels 32 and 42. From the structure just described, it will be appreciated that each unit comprises a chain of shelves 50 adapted to support articles of merchandise.

As has been pointed out hereinabove, the machine 10 is adapted to dispense shallow articles such as candy bars, in which case two shelf elements 50 are attached directly to each other to form the chain of shelves. Alternatively, where a relatively thicker or bulkier article such as a bag of chips is to be dispensed, the shelf spacing must be twice the spacing when adjacent shelves are to be connected. In order to make up a chain having such a spacing we merely insert a spacer 64 between each pair of adjacent shelves. The spacer 64 is the same as the base 52 of a shelf 50. It differs only from the shelf arrangement in that the shelf portion itself is omitted.

My machine includes an escrow member, indicated generally by the reference character 66, of triangular configuration rotatably supported on a shaft 68 at a location below and in front of the chain of shelves 50. The escrow member 66 provides three outer surfaces 70, 72 and 74, each of which includes an extension 76 directed outwardly of the apex of the triangle. As is clearly shown in FIG. 2, in the rest condition of the machine the tip of one of the shelves 50 rests on the extension 76 so that a surface such as the surface 70 of the escrow member together with the shelf, supports an article in a position to be viewed through a window 22.

The drive and delivery mechanism for a pair of adjacent units 28 and 30 includes respective left hand and right hand spring clutches, indicated generally by the reference characters 78 and 80. The machine includes a common drive shaft 82 supported in bearings 84 and 86 in a subframe 88 located below and slightly in front of the escrow members 66. Shaft 82 is adapted to be driven by means of a sprocket wheel 90 carrying a pitch chain which is driven by another sprocket wheel 94 carried by the shaft 96 of a drive motor 97.

The clutch units 78 and 80 are substantially identical with the exception that they are left-hand and right-hand respectively. For this reason, only one of the two units will be described in detail. Clutch unit 78 includes a hub 98 loosely carried on shaft 82. Hub 98 carries for movement therewith a gear 100. The clutch unit 78 further includes a toothed wheel 102 loosely supported on the shaft 82. I secure one end of a clutch coil spring 104 in the hub 98 and selectively secure the other end of the spring in one of a plurality of holes 106 in the wheel 102 to provide the proper clutch action. Axially extending pins 108 on the hub 98 extend into arcuate slots 110 in the toothed wheel 106. A spring 111 bearing between the subframe 88 and the wheel 102 normally urges the parts toward the center of the double clutch unit. It will be appreciated that the setting of the clutch can be changed merely by relieving the pressure of spring 111 and moving the end of the corresponding spring 104 to a new hole 106. It will further be appreciated that there are two generally diametrically opposite sets of holes 106 in each of the toothed wheels 102, so that the wheel of a left hand clutch unit is interchangeable with the wheel of a right hand clutch unit.

Each of the units 78 and 80 includes a latch 112 adapted to engage the teeth of the wheel 102. A slot 114 in a bracket 116 on the subframe 88 supports the latch for sliding movement. A pin 122 carried by the armature 120 of a solenoid 118 connects the armature to one of the latches 112. A spring 124 normally urges the latch to a position at which it rides on the periphery of wheel 102 so as to engage a tooth thereof.

Each of the clutch assemblies I employ includes a lever 126 pivotally supported on a pin 128 carried by a bracket 130 on the frame 88. A spring 132 normally urges the lever to a position at which a cam surface 134 thereon rides on the hub 98. I provide the hub 98 with a plurality of spaced, outwardly extending lugs 136 adapted to be engaged by the surface 134 of lever 126 in the course of a partial revolution of the hub so as to assist in disengaging the clutch unit in a manner to be described.

A guide 138 extending across the machine below all of the sections is adapted to receive an article of merchandise released by one of the sections so as to direct it onto the delivery tray 26.

Figure 2:
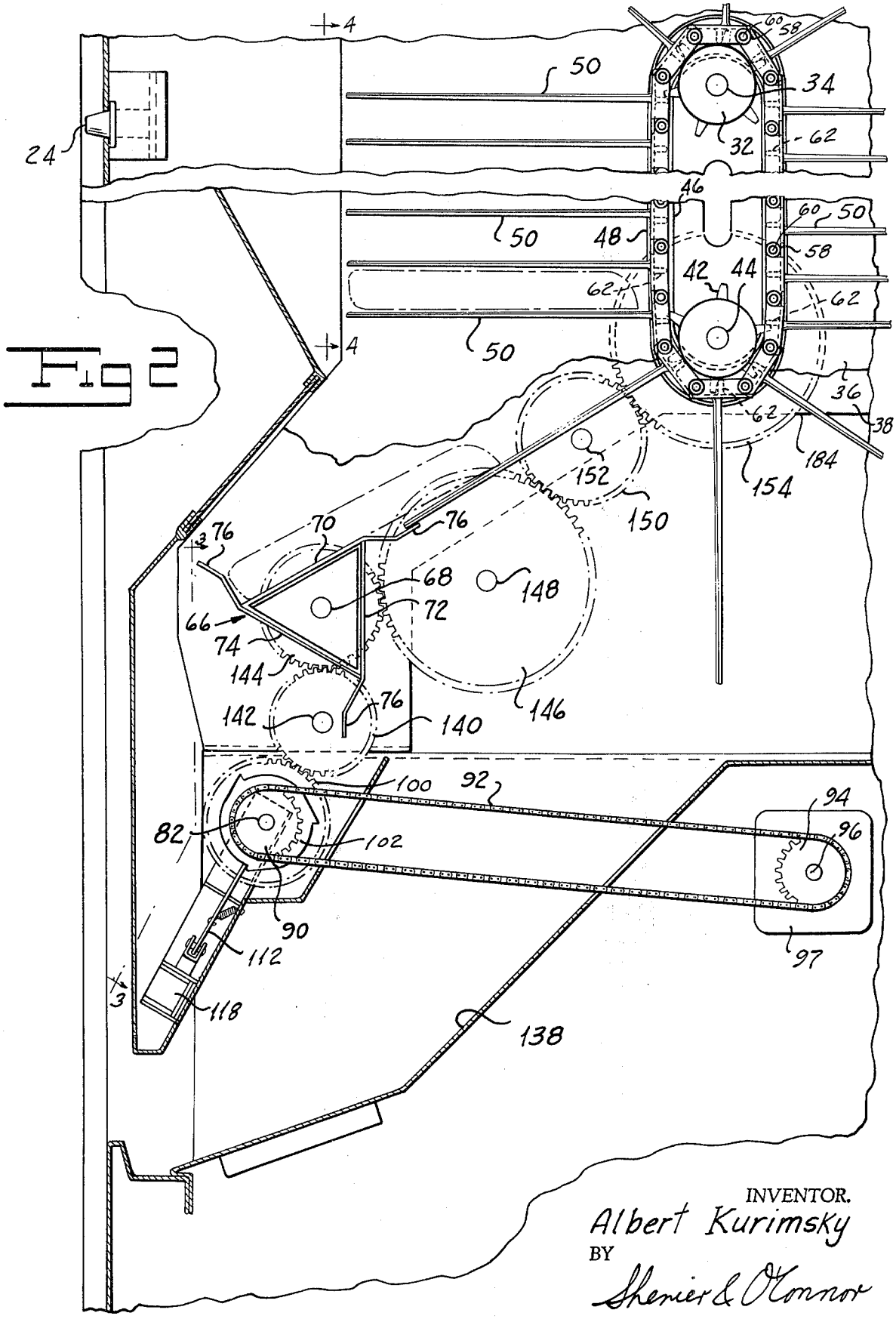
FIG. 2 is a sectional view of my improved delivery mechanism for a FIFO merchandising machine taken along the line 2—2 of FIG. 1.
Figure 3:
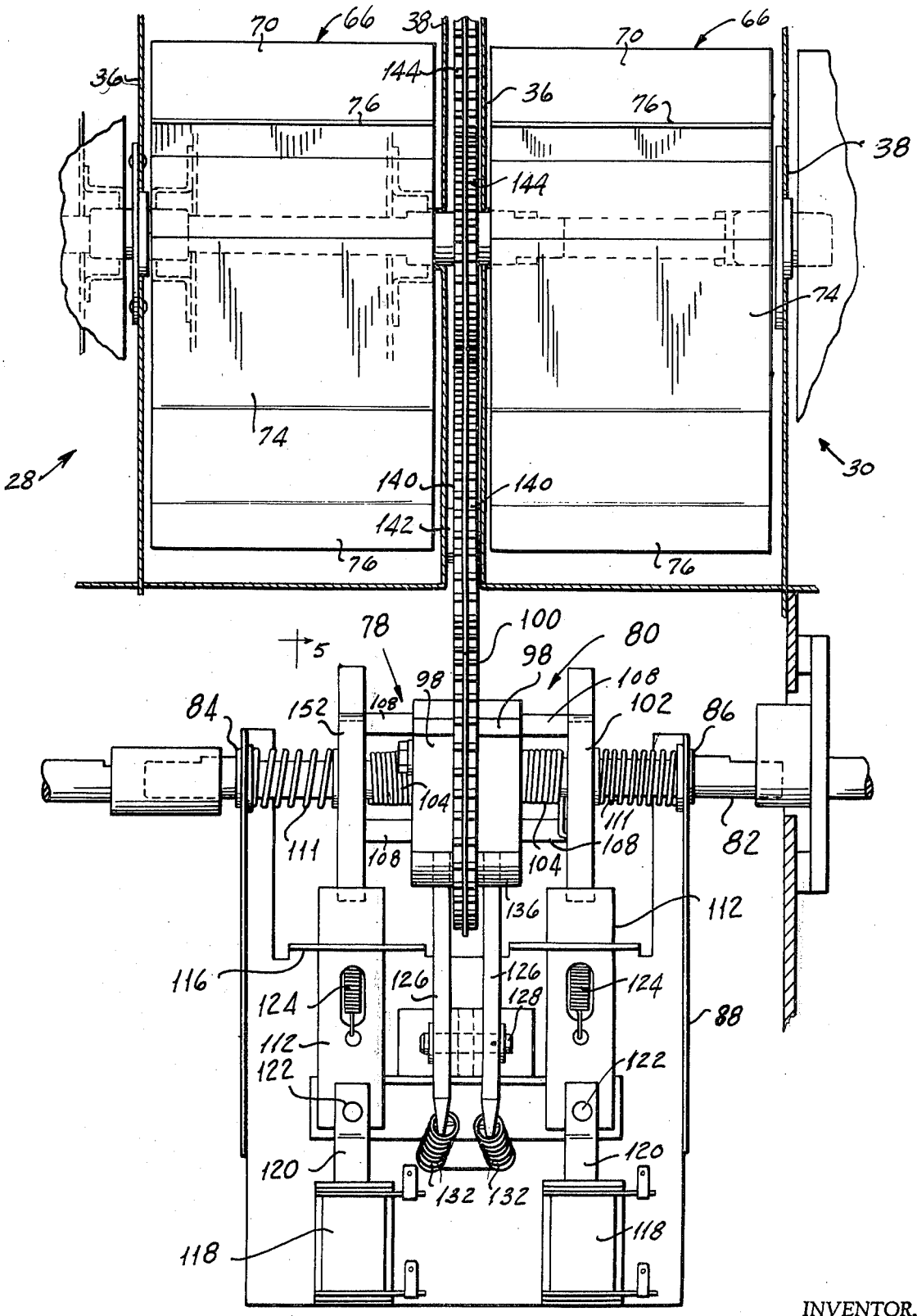
FIG. 3 is a front elevation of the bottom portion of the mechanism shown in FIG. 2 taken along the line 3—3 of FIG. 2 and drawn on an enlarged scale.
Figure 4:
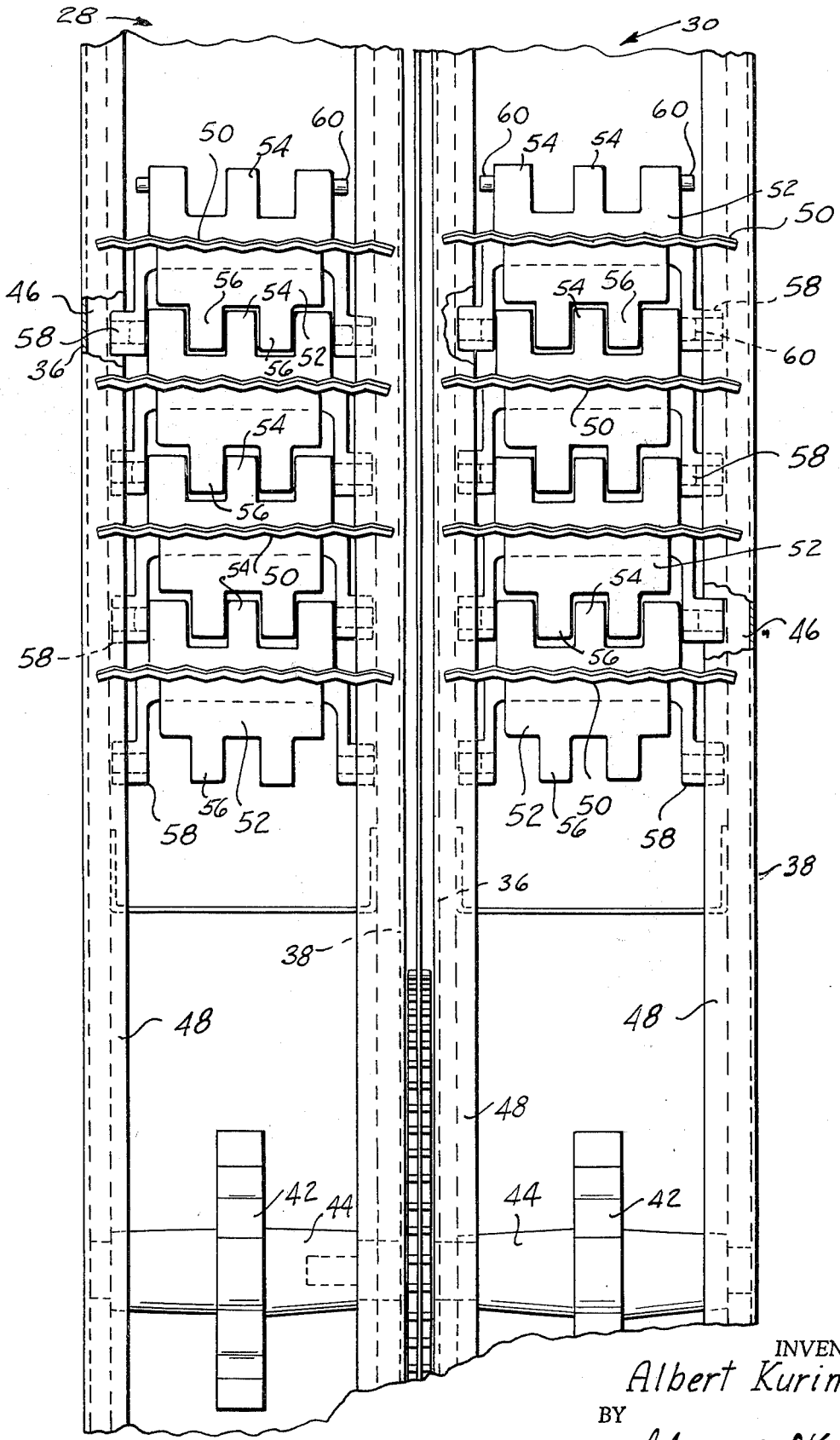
FIG. 4 is a front elevation of the top portion of the mechanism shown in FIG. 2 taken along the line 4—4 of FIG. 2 and drawn on an enlarged scale.

When a clutch 78 and 80 is actuated in a manner to be described, its hub 98 and the gear carried thereby rotate through one-third of a revolution. This will be apparent from the fact that three teeth are provided on each wheel 102. As the gear 100 rotates, it drives a gear 140 supported on the panels 36 and 38 by a shaft 142. Gear 140 in turn engages and drives a gear 144 on shaft 68. Owing to the fact that all of the gears 100, 140 and 144 are of the same pitch diameter, as shaft 82 rotates through one-third of a revolution the escrow member 66 likewise rotates through one-third of a revolution. Where I arrange my delivery mechanism to deliver an article such as a bar of candy or the like, the shaft 44 of the drive sprocket 42 must be driven through 60° or one-sixth of a revolution in order to move a shelf 50 from the position at which it cooperates with a projection 76 on the escrow member 66 to a generally downwardly vertically extending position as shown in FIG. 2. In such an installation, gear 144 drives a gear 146 carried by a shaft 148 on panels 36 and 38. Gear 146 has a diameter which is substantially twice the diameter of gear 144 so that as gear 144 drives through one-third of a revolution, gear 146 drives through one-sixth of a revolution or 60°. An idler gear 150 carried by a shaft 152 supported on panels 36 and 38 couples gear 146 to a gear 154 on shaft 44. I select gear 154 to be of the same diameter as is gear 146 so that when gear 146 rotates through 60° gear 154 rotates through 60°.

As has been pointed out hereinabove, where the section under consideration is to contain articles such as bags of potato chips or other relatively bulky articles, we so arrange the chain of shelves 50 that a spacer 64 is located between each pair of adjacent shelves 50. In this form of the section, the shaft 44 must be driven through one-third of a revolution on each operation of the machine rather than through merely one-sixth of a revolution. This result is easily accomplished by replacing gear 150 with one having the same diameter as gear 146 and by replacing gear 154 with one having the same diameter as gear 144.

Figure 7:
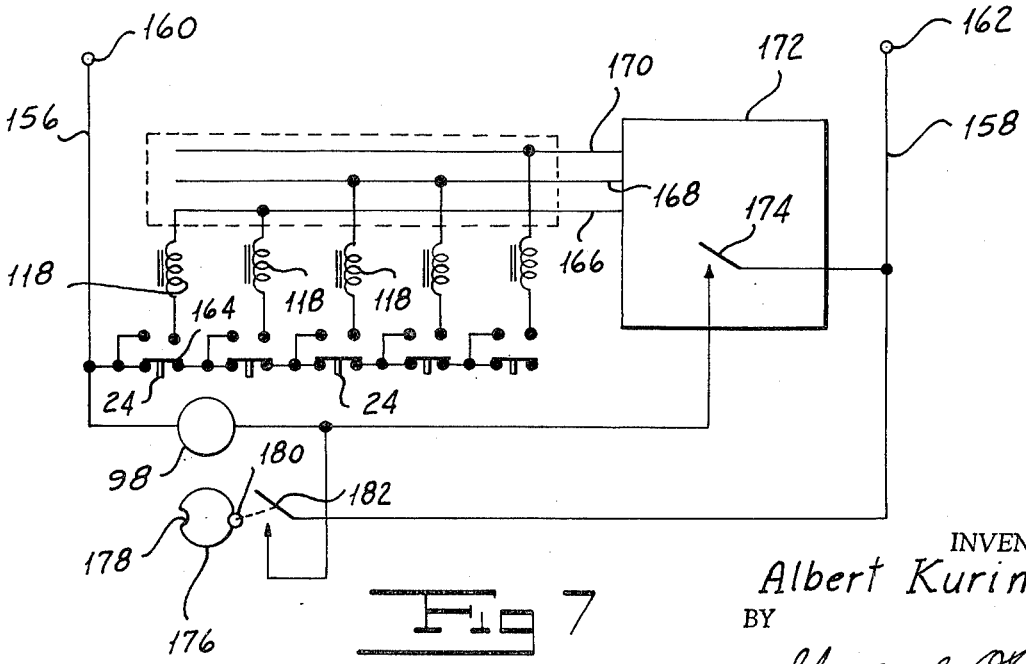
FIG. 7 is a schematic view of one form of electrical circuit which can be used to control my improved delivery mechanism for a FIFO merchandising machine.

Referring now to FIG. 7, I have shown a portion of an electrical circuit which may be used to control my operating mechanism. The circuit includes respective conductors 156 and 158 connected to the terminals 160 and 162 of a suitable source of electrical energy. The push buttons 24 are arranged to operate switches 164 adapted to be moved to positions at which they connect one end of respective windings 118 to conductor 156. The arrangement is such that actuation of any switch 24 prevents concomitant actuation of another switch to complete the circuit of more than one winding 118 at a time. I selectively connect the other terminals of the solenoid windings 118 to price lines 166, 168 and 170 depending upon the price at which the item associated with the solenoid is to be sold. Price lines 166, 168 and 170 lead into a coin mechanism 172 of any suitable type known to the art. When a sum in coins corresponding to the purchase price of a desired article is inserted in the mechanism 172, and upon operation of the proper button 24, the circuit of the corresponding solenoid will be energized and a switch 174 closes to energize motor 98. Motor 98 drives the cam 176 having diametrically opposite recesses 178 for receiving a follower 180 adapted to operate a switch 182. As soon as the motor 98 begins to rotate, follower 180 moves out of a recess 78 to close switch 182 to complete a holding circuit for the motor 98 over a half revolution of its shaft.

I cut out the lower portion of each of the dividing panels 36 and 38 inboard of the end panels along a line indicated by the reference character 184 in FIG. 2. When a unit is arranged to dispense articles such as bags of chips or the like, a bag to be dispensed may become wedged between a pair of adjacent panels 36 and 38. However, as the following panel or shelf 50 moves into a position at which it cooperates with a projection 76 to display the next article the underside of this following shelf engages the stuck pack and positively moves it to the space formed by the cutouts of the panels to free it for movement down chute 138. Another situation which may occur is that a part of a bag or the like may become wedged between the edge of a shelf and a panel. When this occurs the bag is freed as the shelf moves into registry with the cutouts. Thus the customer is not cheated and the machine does not jam.

In assembling my machine, I first determine how many of the units 28 and 30 are to contain relatively shallow or less bulky articles such as bars of candy and how many of the units are to contain more bulky items such as bags of chips and the like. The end units or sections are made to dispense the less bulky articles since the end panels have no cutouts 184 which are provided in the other panels to overcome the problem of wedging and jamming of the more bulky articles. Our construction permits a section to be made to dispense articles of either type with relative ease. Where the section is to deliver less bulky articles a plurality of the paddles or shelves 50 are directly interconnected to form an endless chain around the sprocket wheels 32 and 42. For this installation the gears 144, 146, 150 and 154 are so selected as to produce 60° of rotation of gear 154 in response to one-third of a revolution of gear 100. If the section is to dispense more bulky articles such as bags of chips, spacers 64 are interposed between each pair of adjacent shelves 50 in making up the supply belt. In this installation gears 150 and 154 may be replaced by gears having the same diameters respectively as gears 146 and 144 to cause sprocket wheel 42 to rotate through one-third of a revolution in response to one-third of a revolution of shaft 82.

Figure 5:
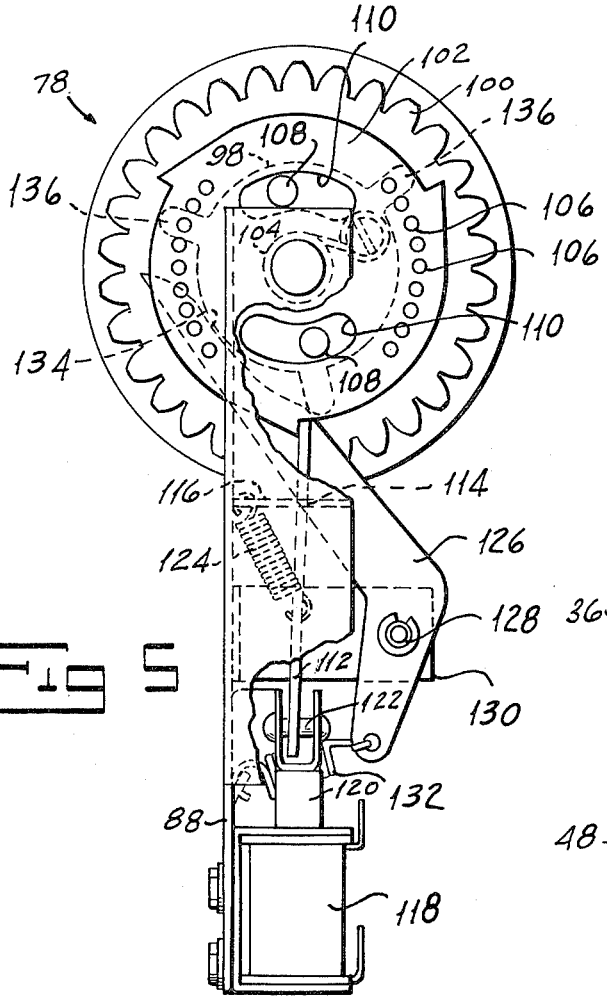
FIG. 5 is a side elevation of a portion of the mechanism illustrated in FIG. 3 taken along the line 5—5 of FIG. 3.
Figure 6:
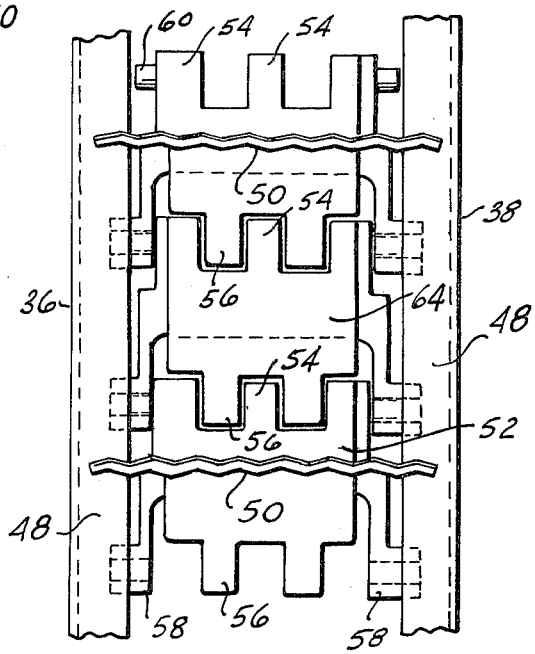
FIG. 6 is a fragmentary view illustrating an alternate supply paddle chain construction.

In operation of a machine 10 incorporating my improved delivery mechanism, before the customer inserts money and before a selection is made, a shelf 50 of each unit cooperates with the projection 76 of the escrow member 66 so that a surface such as the surface 70 of the escrow member and the shelf cooperates to support an article at a position at which it can be viewed through the window 22. At the same time, all of the latches 112 are in positions at which they engage teeth of their associated clutch wheels 102 so that all of the clutches are disengaged. When a customer desires to make a selection, he deposits a sum aggregating the purchase price of a selected article and operates a button 24 to move the corresponding switch 164 to energize solenoid 118 and to energize motor 98 so that the motor begins to drive. Upon energization of the winding 118 the associated latch 112 is moved downwardly as viewed in FIG. 5 to release the wheel 102. When that occurs the associated spring 104 winds itself around shaft 82 so that the corresponding hub 98 is driven. As the hub rotates, gear 100 rotates with the hub to drive the gear 140 which drives gear 144 to drive gear 146 to drive gear 150 which rotates gear 154. If the selected article is a bar of candy or the like, as the gear 144 rotates through one-third of a revolution and gear 154 rotates through one-sixth of a revolution, the surface 70 and its associated projection 76, together with the paddle or shelf 50 which had supported an article open in the manner of a trap door to dump the article which had been supported thereby onto the guide 138 along which the article slides to the tray 26. If the selected article is a more bulky one, such as a bag of chips, the wheel 42 drives through one-third of a revolution during the rotation of shaft 82.

It may occur during a dispensing operation, that a bag may become stuck between a pair of panels 36 and 38 so that the force of gravity is not sufficient to cause the article to move onto guide 138 as the paddle below the article moves to the vertically downwardly extending position. In such an event, as the paddle next above moves downwardly to the article display position it positively moves the stuck bag past the cutout edge 184 so that the bag is free to move to guide 138. In another situation, if a portion of a bag becomes wedged between a panel and the side edge of a paddle, it is freed as soon as the paddle moves past edge 184. Thus the customer is not cheated.

During the initial portion of rotation of the hub 98, it drives against the action of the lever 126 as the projection 136 engages cam surface 134. This causes the spring tightly to coil into engagement with shaft 82. As the projection 136 moves past the lever 126, cam surface 134 under the action of spring 132 tends to drive the hub 98 in the same direction as that in which it is being driven by the clutch so as to relieve the spring pressure slightly so that when the next tooth of wheel 102 engages the latch 112 the clutch is quickly released. The machine is now ready for the next operation.

It will be seen that I have accomplished the objects of my invention. I have provided an improved delivery mechanism for a FIFO merchandising machine which overcomes the defects of delivery mechanisms of the prior art. My mechanism is more compact than are mechanisms of the prior art. It permits of a shorter vending cycle than do mechanisms of the prior art. It minimizes the possibility of a customer being cheated in the event of a stuck pack. My mechanism is easily adapted to deliver articles of different sizes.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a merchandising machine, apparatus including a frame, an escrow member having an article receiving surface, a shelf having an article supporting surface, means including first and second shafts respectively mounting said escrow member and said shelf for movement between first positions at which said surfaces cooperate to support an article of merchandise and second positions at which said article is released, a gear train comprising first and second gears carried respectively by said first and second shafts for connecting said shafts, said gear train adapted to be driven concomitantly to drive said shafts in opposite directions, and means responsive to operation of said machine for driving said gear train to move said escrow member from its first position to its second position, the gear ratio provided by said gear train being such that the shelf moves from its first to its second position as said operation responsive means drives said gear train.

2. Apparatus as in claim 1 in which said escrow member and said shelf comprise interengageable portions adapted to engage in said first positions.

3. Apparatus as in claim 1 in which said driving means comprises a shaft, a motor for driving said shaft and means including a spring clutch for coupling said shaft to said gear train.

4. Apparatus as in claim 3 including actuatable means for normally holding said clutch disengaged, said actuatable means adapted to be actuated to permit said clutch to engage for a predetermined rotary displacement of said shaft and means operative during the terminal portion of said displacement for assisting in disengagement of said clutch.

5. Apparatus as in claim 4 in which said clutch comprises a hub loosely supported on said shaft, a toothed wheel loosely supported on said shaft, and a coil spring surrounding said shaft and connected at its ends to said hub and to said wheel, said spring biased to coil about said shaft to couple said hub and said wheel to said shaft for rotation therewith, said actuatable means normally engaging said toothed wheel to hold said wheel against the action of said spring bias to release said clutch and which said assisting means comprises means responsive to rotation of said hub for driving said hub in the direction of movement of said shaft.

6. Apparatus as in claim 5 in which said assisting means comprises a radially extending projection on said hub and a spring loaded lever for engaging said projection.

7. Apparatus as in claim 1 in which said mounting means comprises side panels extending generally perpendicular to the plane of said shelf, said panels being cut away in the region of the second position of said shelf.

8. A merchandising machine for dispensing articles of merchandise including in combination, a plurality of merchandise storage and dispensing units, each of said units comprising an endless chain of merchandise supporting shelves having article supporting surfaces, an escrow member associated with said shelves, said escrow member having an article receiving surface, means comprising respective first and second shafts for mounting said escrow member and said chain for movement from first positions at which said escrow member surface and the surface of a cooperating one of said shelves support an article of merchandise and second positions at which said one shelf and said escrow member release said article, and a gear train comprising gears carried respectively by said first and second shafts for connecting said shafts, each of said gear trains adapted to be driven concomitantly to drive its associated shafts in opposite directions, and means responsive to operation of said machine for selectively driving one of said gear trains to move the associated escrow member from its first position to its second position, the gear ratio provided by said gear train being such that the cooperating shelf moves from its first to its second position as said operation responsive means drives said one gear train.

9. A merchandising machine as in claim 8 in which the shelves of one of said units each comprises a base, extending generally perpendicular to said shelf, said base being formed with teeth along the upper and lower edges thereof, the teeth along the upper edge of one base adapted to mesh with the teeth along the lower edge of an adjacent base.

10. A merchandising machine as in claim 8 in which each of said shelves has a base extending generally perpendicular to said shelf, means forming a socket adjacent to one end of said base and means forming a pivot adjacent to the other end of said base, the socket of one base adapted to receive the pivot of an adjacent shelf to form said chain.

11. A merchandising machine as in claim 8 in which one of said units includes a plurality of spacers interposed between adjacent shelves, each of said shelves having a base, means forming sockets adjacent to one end of each of said bases and said spacers, and means forming pivots adjacent to the other ends of each of said bases and said spacers, the pivot of one shelf or spacer adapted to be received in the socket of an adjacent spacer or shelf to form said chain.

12. A merchandising machine as in claim 8 in which said driving means comprises a drive shaft common to said units, respective clutches on said shaft, respective actuatable means for disengaging said clutches, said clutches associated respectively with said units and respective gear trains for connecting said clutches to their associated escrow members and belts.

13. A merchandising machine as in claim 12 in which each of said clutches is a spring clutch, said disengaging means adapted to be actuated to permit the associated clutch to engage for a predetermined rotary displacement of said shaft, and means responsive to rotation of said clutch for assisting in disengaging said clutch during the terminal part of said rotary displacement.

14. A merchandising machine as in claim 8 including separator panels between adjacent units the said panels being cut out along a line between the first and second positions of said one shelf.

15. A merchandising machine as in claim 8 in which said units are disposed in side by side relationship, the gear trains associated with a pair of adjacent units being located between said units.

* * * * *